US005316286A

United States Patent [19]

Takimoto

[11] Patent Number: 5,316,286

[45] Date of Patent: May 31, 1994

[54] SHEET DISCHARGING APPARATUS FOR USE IN AN IMAGE FORMING APPARATUS

[75] Inventor: Kazushi Takimoto, Kusatsu, Japan

[73] Assignee: Mita Industrial Co., Ltd., Japan

[21] Appl. No.: 920,205

[22] Filed: Jul. 27, 1992

[30] Foreign Application Priority Data

Jul. 30, 1991 [JP] Japan ..... 3-214468
Aug. 7, 1991 [JP] Japan ..... 3-223427

[51] Int. Cl.[5] ..... B65H 29/68
[52] U.S. Cl. ..... 271/182; 271/176
[58] Field of Search ..... 271/182, 183, 176; 355/321, 311; 361/212

[56] References Cited

U.S. PATENT DOCUMENTS 3,757,164 9/1973 Binkowski ..... 361/212
4,667,244 5/1987 Ishikawa ..... 271/121
5,029,839 7/1991 Kajiwara et al. ..... 271/121
5,083,766 1/1992 Osawa ..... 271/121
5,116,042 5/1992 Hamanaka ..... 271/182
5,120,609 6/1992 Blaszak et al. ..... 355/321
5,181,705 1/1993 Ueda et al. ..... 271/3

FOREIGN PATENT DOCUMENTS 3-210797 9/1991 Japan ..... 361/212

OTHER PUBLICATIONS

Schell, "Static Charge Elimination in the Semiautomatic Document Feed of a Copier", IBM Technical Disclosure Bulletin vol. 22 No. 3 p. 912, Aug. 1979.

*Primary Examiner*—David H. Bollinger
*Attorney, Agent, or Firm*—Beveridge, DeGrandi, Weilacher & Young

[57] ABSTRACT

A sheet discharging apparatus is provided with a brake member which can be contact with a sheet discharged from a sheet discharging portion. The brake member is activated when the size of a sheet discharged is sensed to be smaller than a predetermined size.

18 Claims, 16 Drawing Sheets

Solenoid: OFF(At the Time of High-speed Discharging)

Solenoid: ON (At the Time of Low-speed Discharging)

Solenoid: OFF(At the Time of High-speed Discharging)

Solenoid: ON(At the Time of Low-speed Discharging)

Solenoid : OFF(At the Time of High-speed Dischaging)

Solenoid : ON(At the Time of Low-speed Discharging)

SHEET DISCHARGING APPARATUS FOR USE IN AN IMAGE FORMING APPARATUS

BACKGROUND OF THE INVENTION

1. Field of the Invention

The present invention relates to a sheet discharging apparatus for use in an image forming apparatus such as an electrophotographic copying machine, a sorter and a printer.

2. Description of the Prior Art

An ADF (automatic document feeder) is employed, for example, for an electrophotographic copying machine. In the ADF, the conveying speed of originals (sheets) is generally high. Since a discharging speed of originals to be discharged from a discharging mechanism of the ADF is also high, the originals are discharged into a mess unless the discharging speed is reduced. The mess is remarkable particularly when the size of the original is small (for example, B5 and A5), since small-size originals are of light weight. As methods of discharging originals from the above-mentioned ADF, etc. into a well-ordered condition so as to improve stocking capability (aligning capability), methods of electrically reducing the discharging speed and methods of mechanically reducing the discharging speed have conventionally been known.

As one of the methods of mechanically reducing the speed, a method is known where a special discharged original stopper, as shown in FIG. 1, consisting of an elastic body 1 and a stopper body 2 is provided on a discharging portion 5 to align originals discharged in the direction of arrow m1. As another method of mechanically reducing the speed, a method is known where a brake member 3 made of a film or a bar is hung, as shown in FIG. 2, from a discharging outlet 6 onto the discharging portion 5 and originals discharged by discharging rollers 4 in the direction of arrow m2 are brought in contact with the rear surface of the brake member 3 to reduce the discharging speed.

In the method employing the stopper shown in FIG. 1, however, the stocking capability deteriorates because of a rebound of originals unless the discharging outlet is arranged at a position higher than the position where the stopper is arranged. On the other hand, in the method employing the brake member 3 shown in FIG. 2, the stocking capability is not stable for some paper sizes unless the distance between the discharging outlet 6 and the stopper 7 is adjustable. Further, for originals of large sizes, since an unnecessary load is imposed thereon by the brake member 3, the originals can be damaged.

Moreover, as electric methods, a method of reducing a discharging speed by reducing a rotation speed of a discharging roller by controlling the discharging speed with a clutch (Japanese laid-open Patent Application No. S62-12564) and a method of reducing the discharging speed of the discharging roller by reducing a rotation speed of a motor which drives the discharging roller (Japanese laid-open Patent Application S62-269853) have conventionally been known. In automatic document conveying apparatuses of the above prior arts, the stocking capability is improved by reducing the discharging speed just before an original is discharged regardless of the size of the original.

In the apparatus of Japanese laid-open Patent Application S62-12564, however, since two driving systems (a gear and a toothed belt) for a high speed and for a low speed, respectively, are required, it is necessary to provide a changeover clutch and a one-way clutch. Consequently, the mechanism is complicated, and a larger space is required due to the increase in size of the apparatus, thereby increasing the cost.

In the apparatus of Japanese laid-open Patent Application S62-269853, since a separate driving motor is required for a discharging portion, the cost of the motor increases. Moreover, if the discharging portion is driven by the same motor that drives another unit (such as a document conveying portion), the conveying speed of the above-mentioned another unit also decreases when the conveying speed of the discharging portion is low. Consequently, the processing speed of original changeover decreases.

SUMMARY OF THE INVENTION

An object of the present invention is to provide a simple, low-cost sheet discharging apparatus having an excellent stocking capability.

To achieve the above-mentioned object, a sheet discharging apparatus of the present invention is provided with: a brake member which can be brought into contact with a sheet discharged from a sheet processing portion; driving means for bringing said brake member into contact with said sheet discharged; sensing means for sensing a size of said sheet discharged; and controlling means for controlling said driving means so as to be activated when said sensing means senses that the size of said sheet discharged is smaller than a predetermined size.

BRIEF DESCRIPTION OF THE DRAWINGS

This and other objects and features of this invention will become clear from the following description taken in conjunction with the preferred embodiments with reference to the accompanied drawings in which.

DESCRIPTION OF THE PREFERRED EMBODIMENTS

Embodiments of the present invention will hereinafter be described with reference to the drawings.

Figure 1:
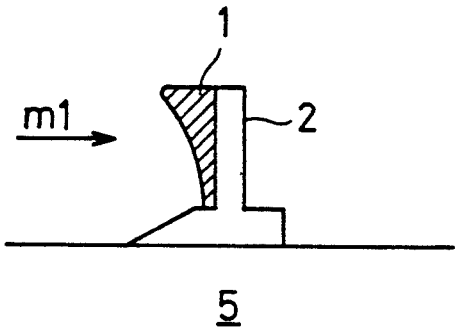
Fig.1 Prior art
FIG. 1 is a side view showing a discharged original stopper employed for a conventional sheet discharging mechanism.
Figure 2:
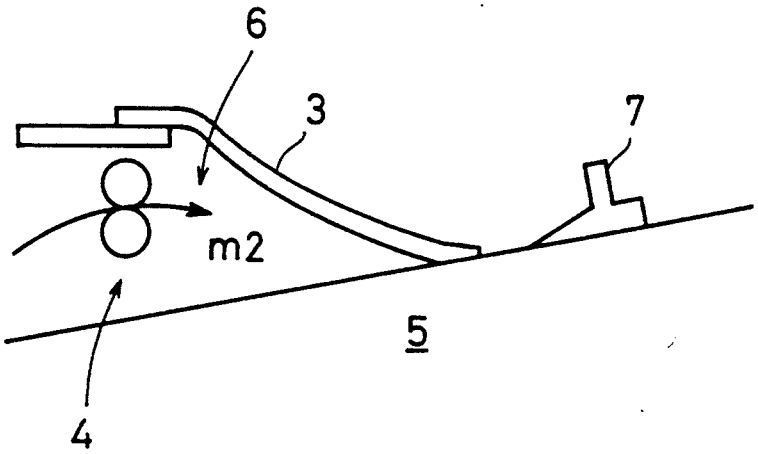
FIG. 2 is a side view showing a schematic arrangement of a main portion of another conventional sheet discharging mechanism.
Figure 3:
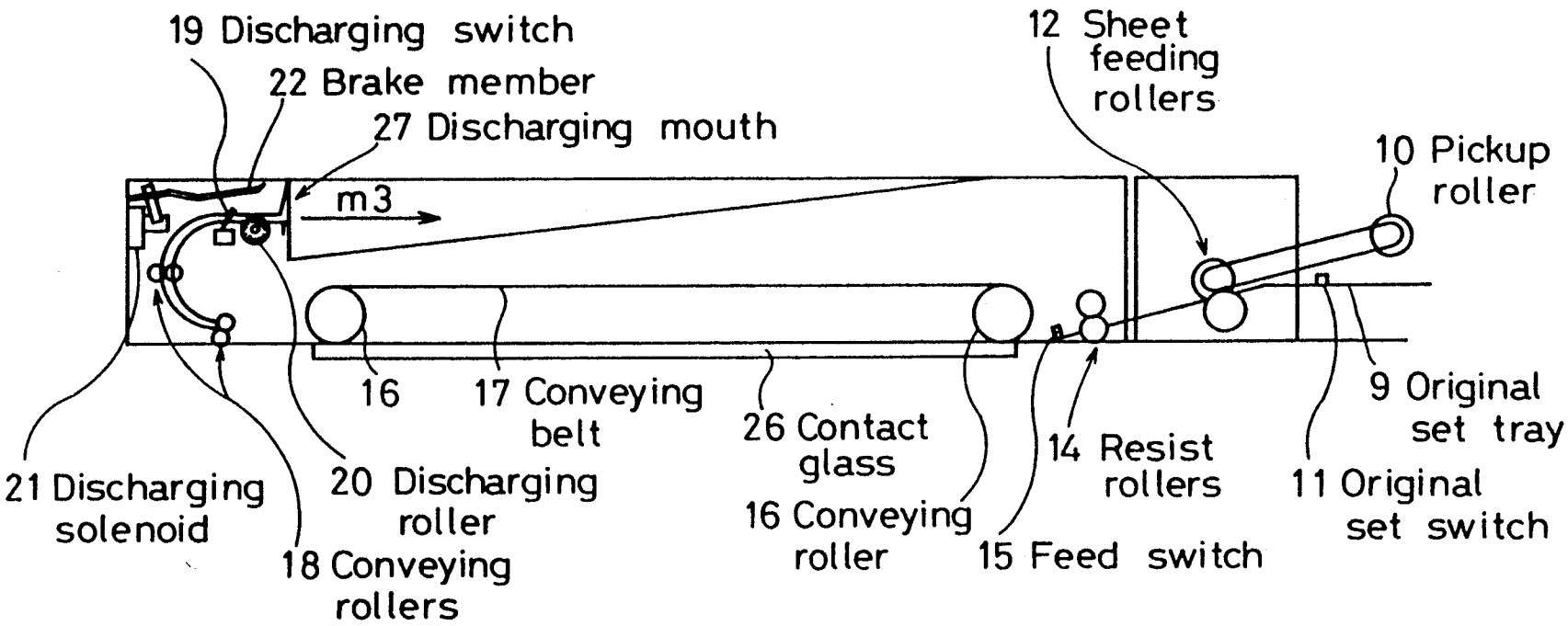
FIG. 3 is a schematic view showing an arrangement of an ADF employing a first embodiment of the present invention.
Figure 4:
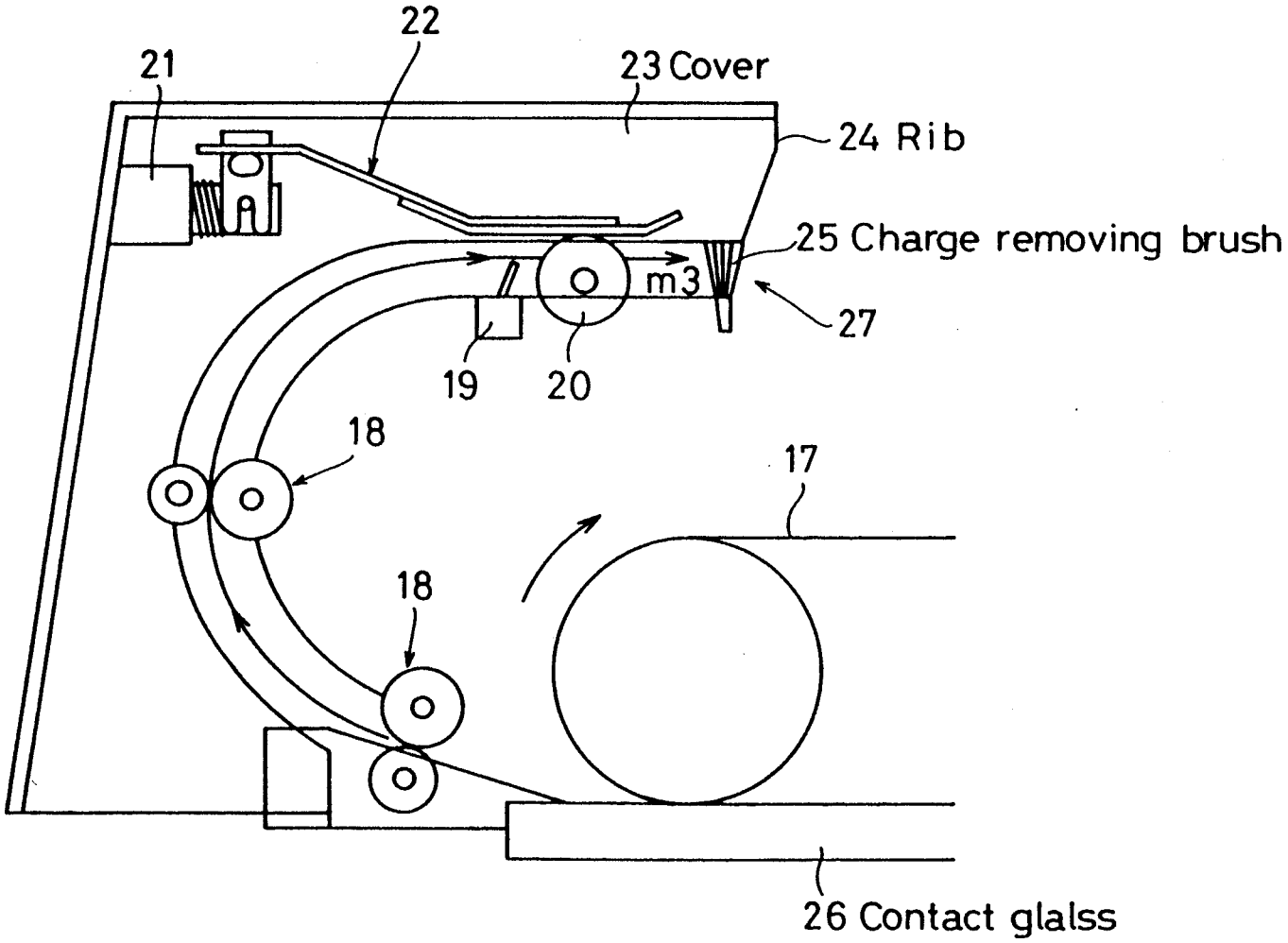
FIG. 4 is a schematic view showing an arrangement of a sheet discharging portion of the ADF employing the first embodiment of the present invention.

FIG. 3 shows a schematic arrangement of an ADF employing a first embodiment of the present invention. FIG. 4 shows an arrangement of a sheet discharging portion of FIG. 3. Originals to be discharged are always placed onto an original set tray 9. When an original is placed onto the original set tray 9, an original set switch 11 is turned on. A sheaf of originals are taken into the ADF one by one from the upper one by a pickup roller 10, and are fed by sheet feeding rollers 12. The sheet feeding timing is controlled by resist rollers 14. The originals are set onto a predetermined position on a contact glass 26 by a conveying belt 17 stretched between conveying rollers 16.

In the first embodiment, a period of time for which a feed switch 15 provided to sense the size of an original to be discharged is ON corresponds to the size of the original. After a copying operation, the original is conveyed toward a discharging outlet 27 by the conveying belt 17 and the conveying rollers 18, and is discharged by a discharging roller 20 in the direction of arrow m3. A discharging switch 19 is provided in the vicinity of the discharging outlet 27. When the original is placed thereon, the discharging switch 19 is turned on to sense the passing of the original. As subsequently described, a discharging solenoid 21 is driven by the discharging switch 19 which is turned on when a small-size original passes on the discharging roller 20, so that the tip of a brake member 22 descends onto the original.

Figure 5:
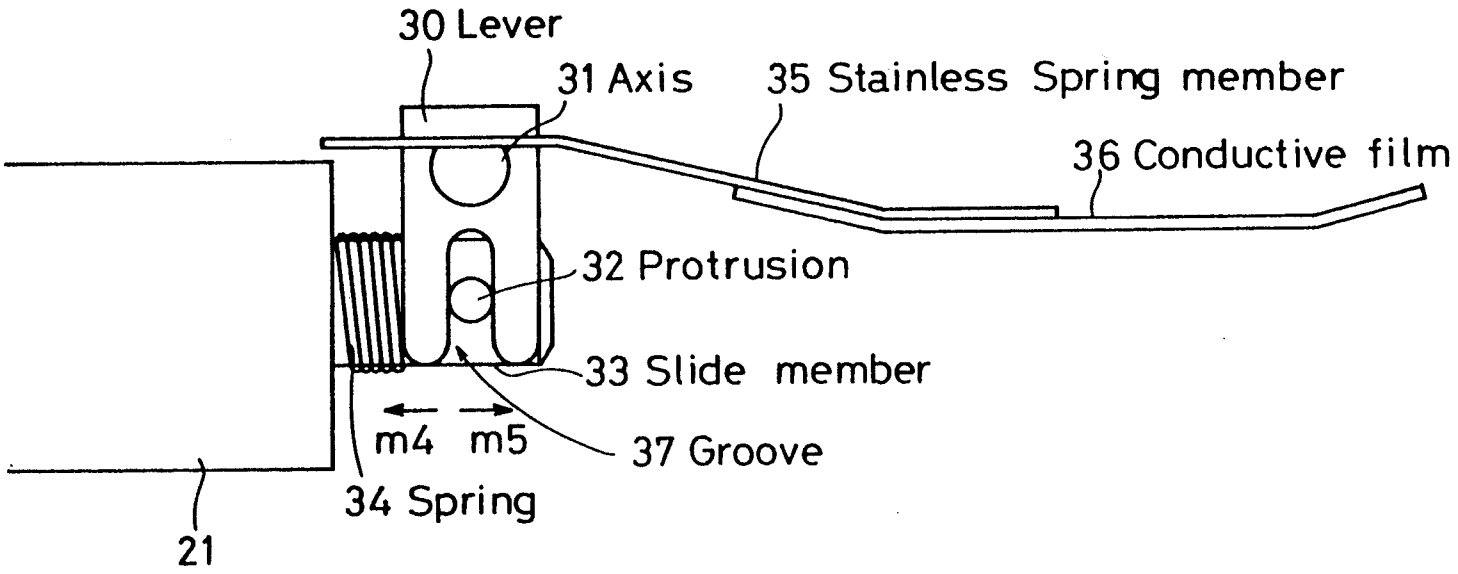
FIG. 5 is a schematic view showing an arrangement of a brake member employed for the first embodiment of the present invention.

As shown in FIG. 5, the brake member 22 consists of the discharging solenoid (SOL) 21, a slide member 33 to which a protrusion 32 is fixed, a lever 30 having a groove 37 with which the protrusion 32 is engaged, a stainless spring member 35 fixed to the lever 30 and a conductive film 36 fixed to the tip of the stainless spring member 35. To prevent the generation of static electricity, the conductive film 36 is used and a charge removing brush 25 is provided in the discharging outlet 27. It is unnecessary to provide the conductive film 36 to a portion where the brake member 22 is in contact with the original; however, it is preferable to provide thereto a member having an appropriate elasticity and which generates appropriate frictional force without damaging the original.

A spring 34 is provided around the slide member 33 between the discharging solenoid 21 and the lever 30. When the discharging solenoid 21 is activated, the slide member 33 moves in the direction of arrow m4 against the resiliency of the spring 34. Consequently, the protrusion 32 moves in the direction of arrow m4 to rotate clockwise the lever 30 which is rotatable about an axis 31, the stainless spring member 35 and the conductive film 36, thereby bringing the conductive film in contact with the original. When the discharging solenoid 21 is disabled, the slide member 33 moves in the direction of arrow m5 due to the resiliency of the spring 34. Consequently, the protrusion 32 moves in the direction of arrow m5 to rotate counterclockwise the lever 30 which is rotatable about the axis 31, a stainless spring member 35 and the conductive film 36, thereby separating the conductive film 36 from the original.

Figure 6:
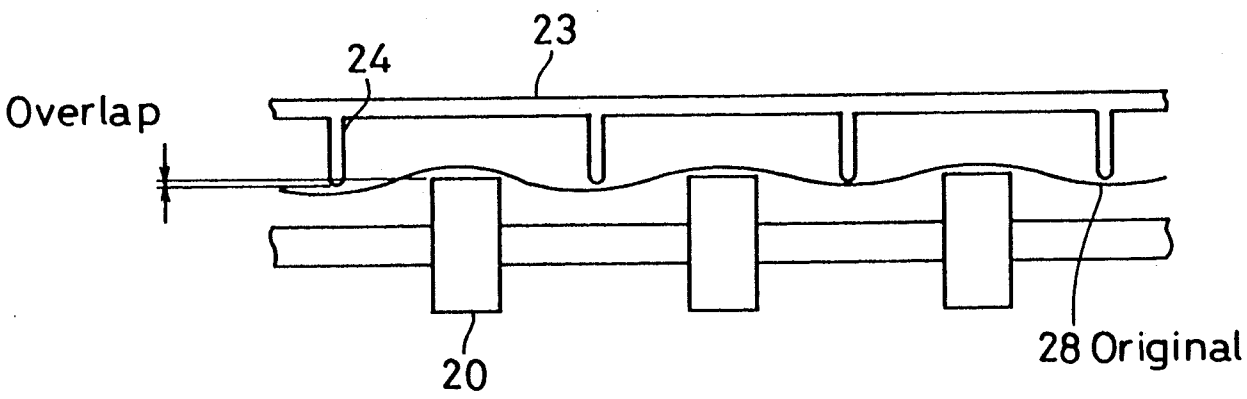
FIG. 6 is a view showing a position relationship between a discharging roller and a rib of the first embodiment of the present invention.

FIG. 6 shows the discharging roller 20 and a rib 24 provided to a cover 23 of the first embodiment which roller and rib are viewed from the discharging outlet 27 side. As shown in the figure, an original 28 is conveyed by the discharging roller 20 and the rib 24 of the cover 23. The cover 20 has a plurality of spaces 20*a* therein, so that the rib 24 can overlap the roller 20. Because of this, there is approximately 2-mm overlap of the rib 24 and the roller 20, the original 28 is tightly nipped between them, thereby obtaining conveying force.

The brake member 22 is rotatably arranged to face the discharging roller 20 as shown in FIGS. 3 and 4, and is activated just before an original passes which is of a small size such as B6, A5 and A6 which has a comparatively inferior stocking capability. After a preceding original is discharged, the brake member 22 can be brought in contact with a subsequently-discharged original from the time when it is sensed that the original is of a small size to the time when the original is brought into a condition where the rear tip of the original can be brought in contact with the brake member 22. Therefore, during this period, the brake member 22 may be activated in advance to bring the conductive film 36 in contact with the discharging roller 20 before the original is conveyed to the discharging roller 20.

Figure 7:
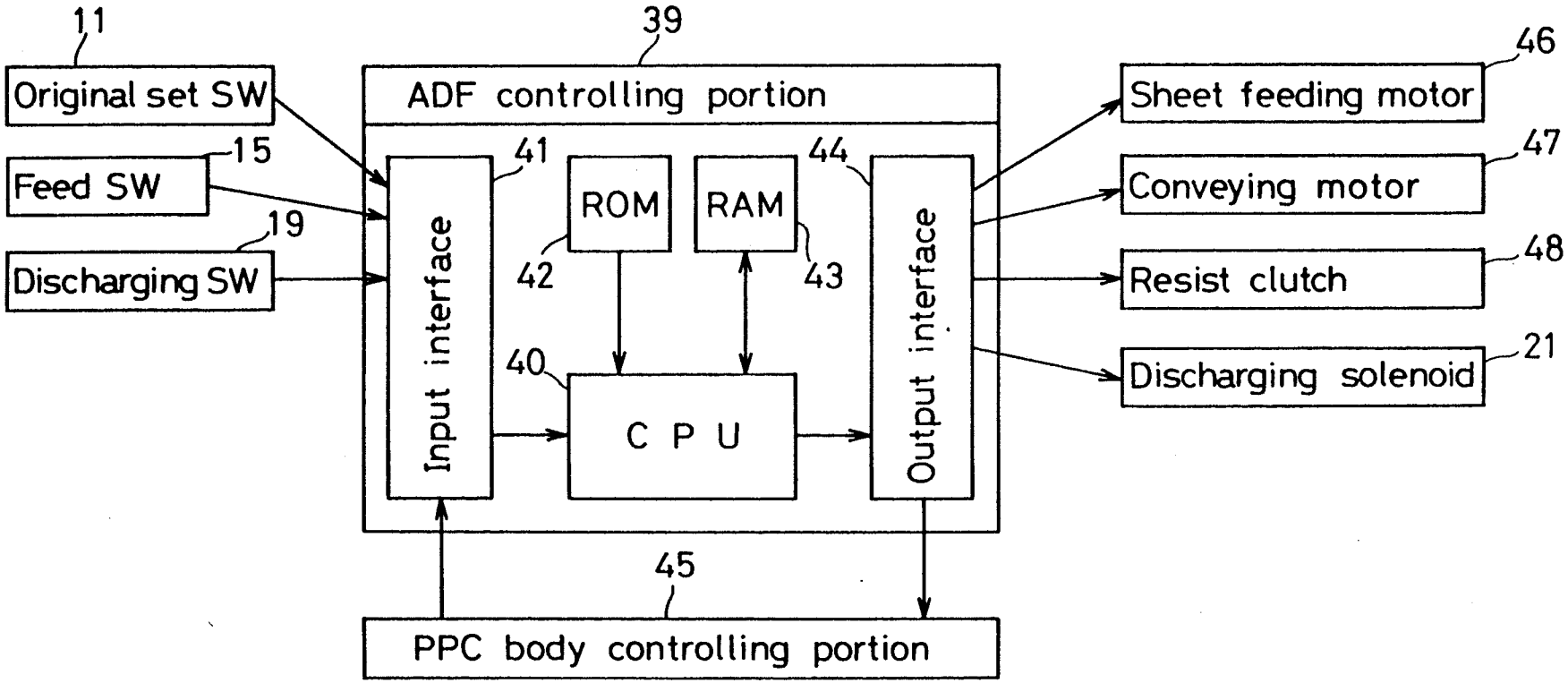
FIG. 7 is a block diagram showing a relationship between an ADF controlling portion and portions which perform communication with the ADF controlling portion employing the first embodiment of the present invention.

Subsequently, a control relationship between the ADF employing the first embodiment of the present invention and an electrophotographic copying machine (PPC) will be described with reference to FIG. 7.

An ADF controlling portion 39 includes a CPU (central processing unit) 40, a ROM (read only memory) 42, a RAM (random access memory) 43, an input interface 41 and an output interface 44. The input interface 41 transmits to the CPU 40 signals from three switches 11, 15 and 19 shown in FIG. 3 and a PPC body controlling portion 45 to the CPU 40. The output interface 44 transmits a signal from the CPU 40 to a sheet feeding motor 46, a conveying motor 47, a resist clutch 48, the discharging solenoid 21 and the PPC body controlling portion 45. For example, communication between the ADF controlling portion 39 and the PPC body controlling portion 45 is performed by transmitting a signal representing that the feeding of an original is started on the turning on of a printing key or that originals are exchanged every time exposure is finished.

The sheet feeding motor 46 drives the sheet feeding rollers 12 shown in FIG. 3 to introduce an original which is placed on the original set tray 9 into the ADF. The conveying motor 47 drives the conveying belt 17 by rotating the conveying rollers 16 to move the original onto the contact glass 26. Then, the conveying motor 47 drives the conveying rollers 18 and the discharging roller 20 to discharge the original with respect to which a copying operation has been finished. The resist clutch 48 transmits to the resist rollers 14 and cuts off therefrom the driving by the conveying motor 47. The discharging solenoid 21 brings the brake member 22 in contact with the original being conveyed by the discharging roller 20 and separates the brake member 22 from the original. As previously described, when the discharging solenoid 21 is activated, the brake member 22 is brought in contact with the original placed on the discharging roller 20, and when the discharging solenoid 21 is disabled, the brake member 22 is separated from the original placed on the discharging roller 20.

The original set switch 11 is turned on when an original is set onto the original set tray 9. The feed switch 15, which is provided in the downstream side of the resist rollers 14, senses the front and rear tips of the original. The conveying belt 17 is stopped after a predetermined period of time has passed since the rear tip of the original was sensed to set the original at a predetermined original position on the contact glass 26. Moreover, the period of time from when the feed switch 15 is turned on to when it is turned off is measured to sense the size of the original. Sensing that the original has been discharged, the discharging switch 19 controls the timing with a subsequently-discharged original.

Subsequently, an operation of the first embodiment of the present invention will be described with reference to a flow chart of FIG. 8 (the first half of the operation) and a flow chart of FIG. 9 (the latter half of the operation).

Figure 8:
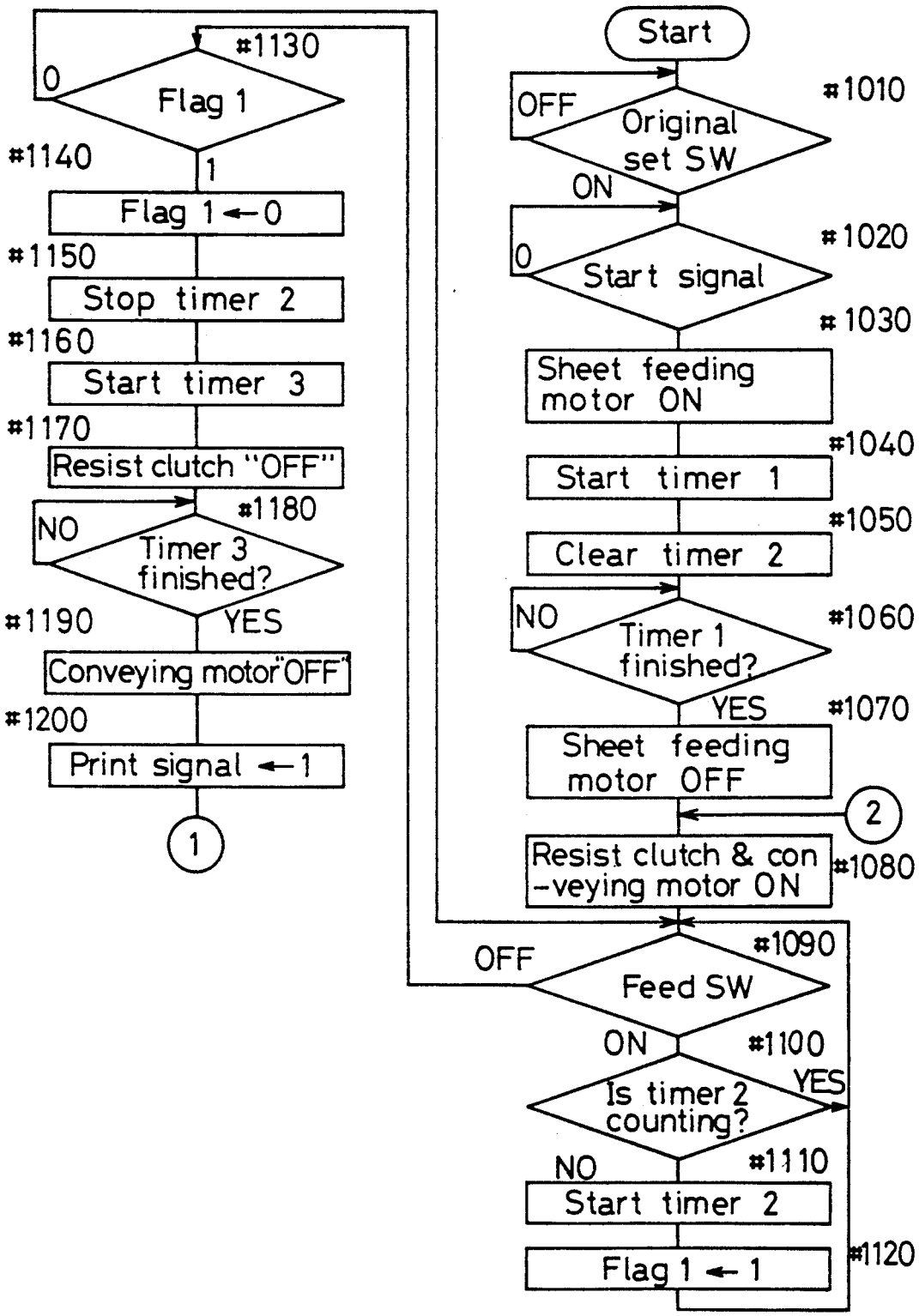
FIG. 8 is a flow chart showing the first half of an operation of the ADF employing the first embodiment of the present invention.

In the flow chart of FIG. 8, at step #1010, the process waits until an original is placed onto the original set tray 9, that is, until the original set switch 11 is turned on. When an original is placed onto the original set tray 9, whether a printing key of the copying machine has been depressed or not is determined at step #1020. When the printing key has been depressed and a signal representative of the starting of the original feeding reaches, a start signal is set to 1. When the start signal is set to 1, the sheet feeding motor 46 is activated to drive the sheet feeding rollers 12 at step #1030, and originals are conveyed one by one.

Then, a timer 1 is started at step #1040. The timer 1 is started in order to measure the period of time required for the tip of the original to move from the original set switch 11 to the resist rollers 14. After the movement time period is measured, the tip of the original is brought in contact with the resist roller 14. Then, the original is slightly further conveyed. Thereby, the original is in contact with only the resist rollers 14 arranged on one side of the conveying path. As a result, the original can be rearranged when it is obliquely fed.

Then, at step #1050, the timer 2 is cleared. At step #1060, whether the timer 1 has finished counting or not is determined. When a primary sheet feeding from steps #1040 to #1060 is completed by the finish of counting of the timer 1, the sheet feeding motor 46 is disabled at step #1070. At step #1080, the resist clutch 48 and the conveying motor 47 are activated to convey the original onto the contact glass 26. The resist roller 14, the conveying belt 17 and the discharging roller 20 are driven by the activation of the conveying motor 47.

Since the feed switch 15 provided in the downstream side of the resist roller 14 is OFF until the original is conveyed thereto, ON/OFF of the switch 15 is determined at step #1090. The process proceeds to step #1130 when the switch 15 is OFF, and to step #1100 when the switch 15 is ON.

At step #1100, whether the timer 2 is counting or not is determined. When the timer 2 is counting, the process returns to step #1090. When it is not counting, the process proceeds to step #1110, where the timer 2 is started. The timer 2 counts the period of time for which the feed switch 15 is ON to sense the size of an original. At step #1120, a flag 1 whose initial value is 0 is set to 1. Then, the process returns to step #1090. The loop of steps #1090 to #1100 is repeated until the feed switch 15 is turned off.

When the feed switch 15 is OFF at step #1090, the process proceeds to step #1130, where whether the flag 1 is 1 or 0 is determined. When the flag 1 is 0, the process returns to step #1090. When the flag 1 is 1, it is set to 1 at step #1140. The flag 1 is set to 1 when the tip of an original is sensed by the feed switch 15.

At step #1150, the timer 2 is stopped. At step #1160, a timer 3 is started. The resist clutch 48 is turned off at step #1170. At step #1180, whether the timer 3 has finished counting or not is determined. The timer 3 is a timer for determining a timing to stop an original. The process waits until the timer 3 finishes counting. When it finishes counting, the conveying motor 47 is disabled at step #1190 to stop the conveying belt 17. Thereby, the original is set at the predetermined original position. At step #1200, a print signal is set to 1. The print signal, which is transmitted from the ADF to the copying machine, is a condition for the copying machine to start exposure. That is, the signal represents that an optical system of the copying machine can start scanning. Since images may flow unless the original is completely stopped, the print signal is transmitted in order to show that the original is completely stopped.

Figure 9:
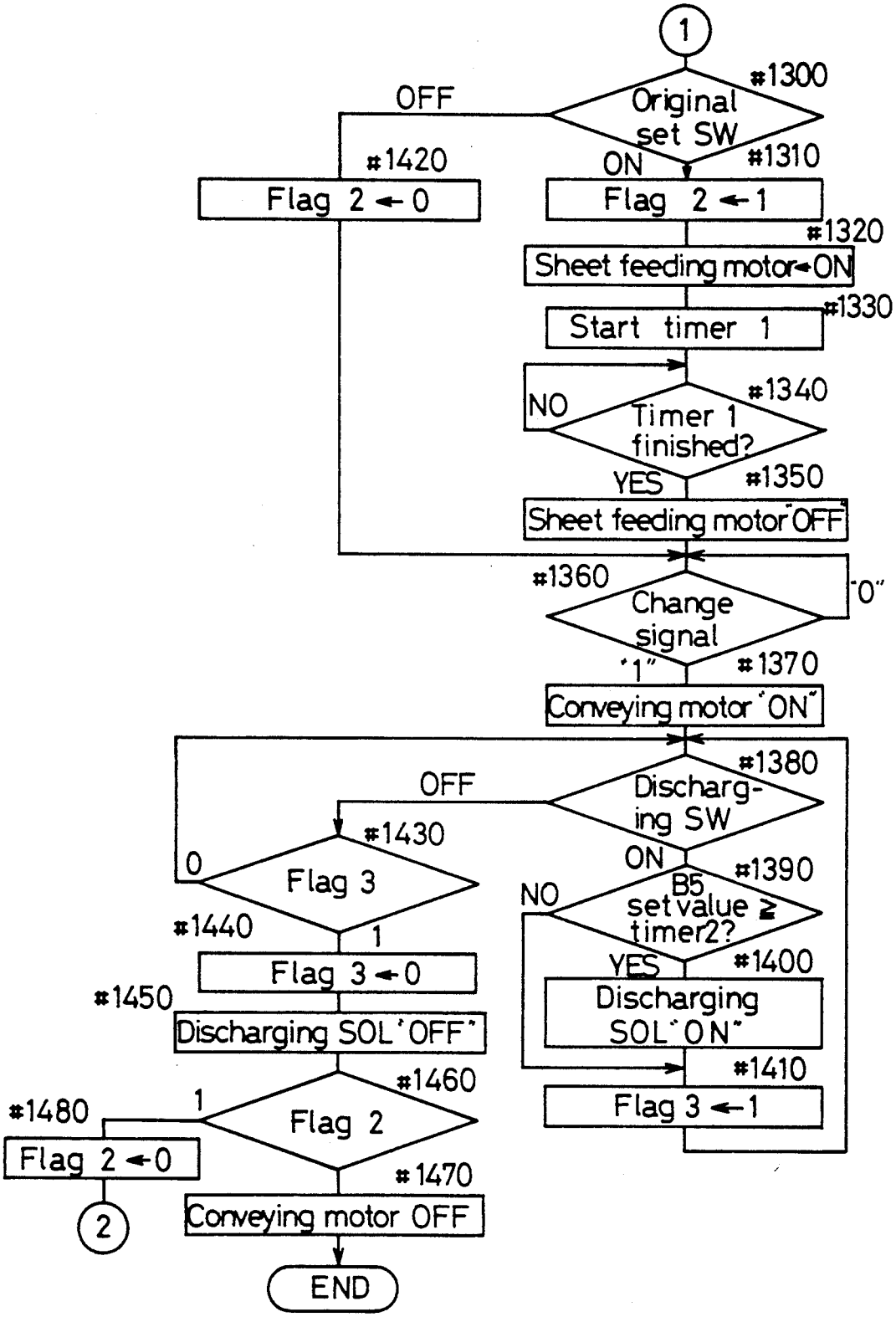
FIG. 9 is a flow chart showing the latter half of the operation of the ADF employing the first embodiment of the present invention.

Then, the process proceeds to the flow of FIG. 9. At step #1300, whether the original set switch 11 is ON or OFF is determined. That is, whether a succeeding original has been placed on the original set tray 9 or not is determined. When a succeeding original has been placed thereon, a flag 2 is set to 1 at step #1310. Then, the sheet feeding motor 46 is activated at step #1320. At step #1330, the timer 1 is started. At step #1340, whether the timer 1 has finished counting or not is determined. Then, the process waits until the timer 1 finishes counting. When the timer 1 finishes counting, the sheet feeding motor 46 is disabled at step #1350. At step #1360, whether a change signal is 1 or 0 is determined. This is because the change signal is set to 1 when the copying machine requests the succeeding original. Waiting for the change signal to be set to 1, the process proceeds to step #1370, where the conveying motor 47 is activated.

When the original set switch 11 is OFF at step #1300, the process proceeds to step #1420. Since there is no succeeding original, the flag 2 is set to 0. At step #1360, whether the change signal is 1 or 0 is determined. Waiting for the change signal to be set to 1, the conveying motor 47 is activated at step #1370.

By the activation of the conveying motor 47, the conveying belt 17 is driven so that the original placed on the contact glass 26 is conveyed toward the discharging outlet 27. The change signal is set to 1 after a copying operation is finished.

Then, at step #1380, whether the discharging switch 19 is ON or OFF is determined. The process proceeds to step #1390 when the discharging switch 19 is ON and to step #1430 when the switch 19 is OFF.

Since the discharging switch 19 is OFF when the original has not reached the discharging switch 19, whether a flag 3 is 1 or 0 is determined at step #1430. The flag 3 is set to 1 when the discharging switch 19 is turned ON. When the flag 3 is 0, the process returns to step #1380. When the flag 3 is 1, the process proceeds to step #1440.

When the discharging switch is ON at step #1380, whether a B5 set value is equal to or higher than the count value of the timer 2 at step #1390. As the B5 set value, a value which is previously stored in a RAM 43 is used. While a period of time corresponding to the value of the timer 2 is used as the B5 set value, size comparison may be made by counting the number of pulses by use of a pulse plate and a photointerruptor attached to a motor. When the count value of the timer 2 is equal to or lower than the B5 set value, the size is determined to be B5 or smaller. After the discharging solenoid 21 is activated at step #1400, the process proceeds to step #1410. When the count value of the timer 2 exceeds the B5 set value, the process proceeds directly to step #1410, where the flag 3 is set to 1. Then, the process returns to step #1380.

The loop of steps #1380 to #1410 is repeated while the discharging switch 19 is ON. When the discharging switch 19 is turned OFF, the process proceeds to step #1430, where whether the flag 3 is 1 or 0 is determined. Since the flag 3 is set to 1 at step #1410, the process proceeds to step #1440, where the flag 3 is set to 0. Then, at step #1450, the discharging solenoid is disabled to separate the brake member 22 from the discharging roller 20. At step #1460, whether the flag 2 is 1 or 0 is determined. When the flag 2 is 0 (that is, when there is no succeeding original), the discharging motor 47 is disabled at step #1470 to finish the flow. When the flag 2 is 1, the flag 2 is set to 0 at step #1480. Then, the process returns to step #1080 of FIG. 8.

Figure 11:
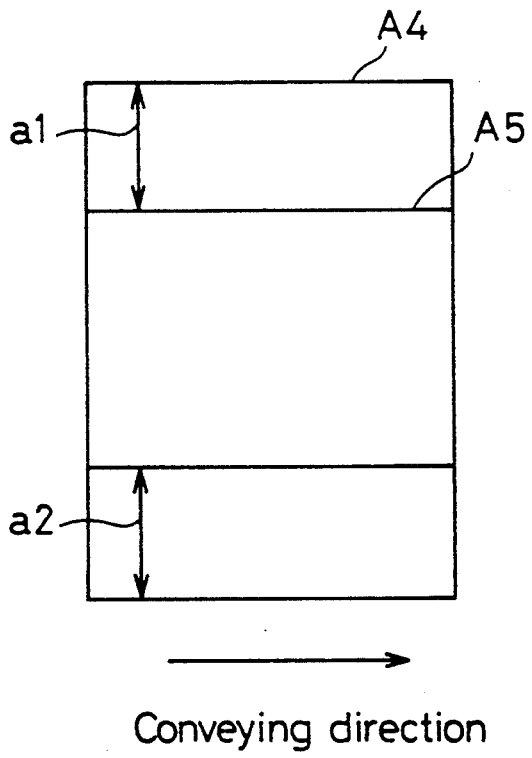
FIG. 11 is a view for explaining a relationship between a position of a size switch provided to determine between a case where an A4-size original is conveyed along a shorter side thereof and a case where an A5-size original is conveyed along a longer side thereof in the second embodiment of the present invention.

In the embodiment of FIGS. 8 and 9, the size of an original is sensed based on the length of a longer side of the original in a case where the original is conveyed along the length (longer side) thereof. In a case where an original is conveyed along a shorter side, however, since a shorter side of an A4-size sheet and a longer side of an A5-size sheet coincide as shown in FIG. 11, both sheets are determined to be of the same size. As a result, it can happen that the discharging solenoid 21 is activated for an original of a size with which there is no need to bring the brake member 22 in contact.

To solve the problem, a size switch may be provided at a position where the feed switch 15 is provided and within a range a1 or a2 of FIG. 11 in order to determine by use of the size switch whether an original is sensed or not. With such an arrangement, it is possible to maintain the discharging solenoid to be OFF in a case where an original is conveyed along a shorter side. In that case, it can be avoided that an unnecessary load is imposed by the brake member 22 on a large-size original having an excellent stocking capability. The feed switch 15 may be used as the size switch. Moreover, the size switch may separately be provided.

Figure 10:
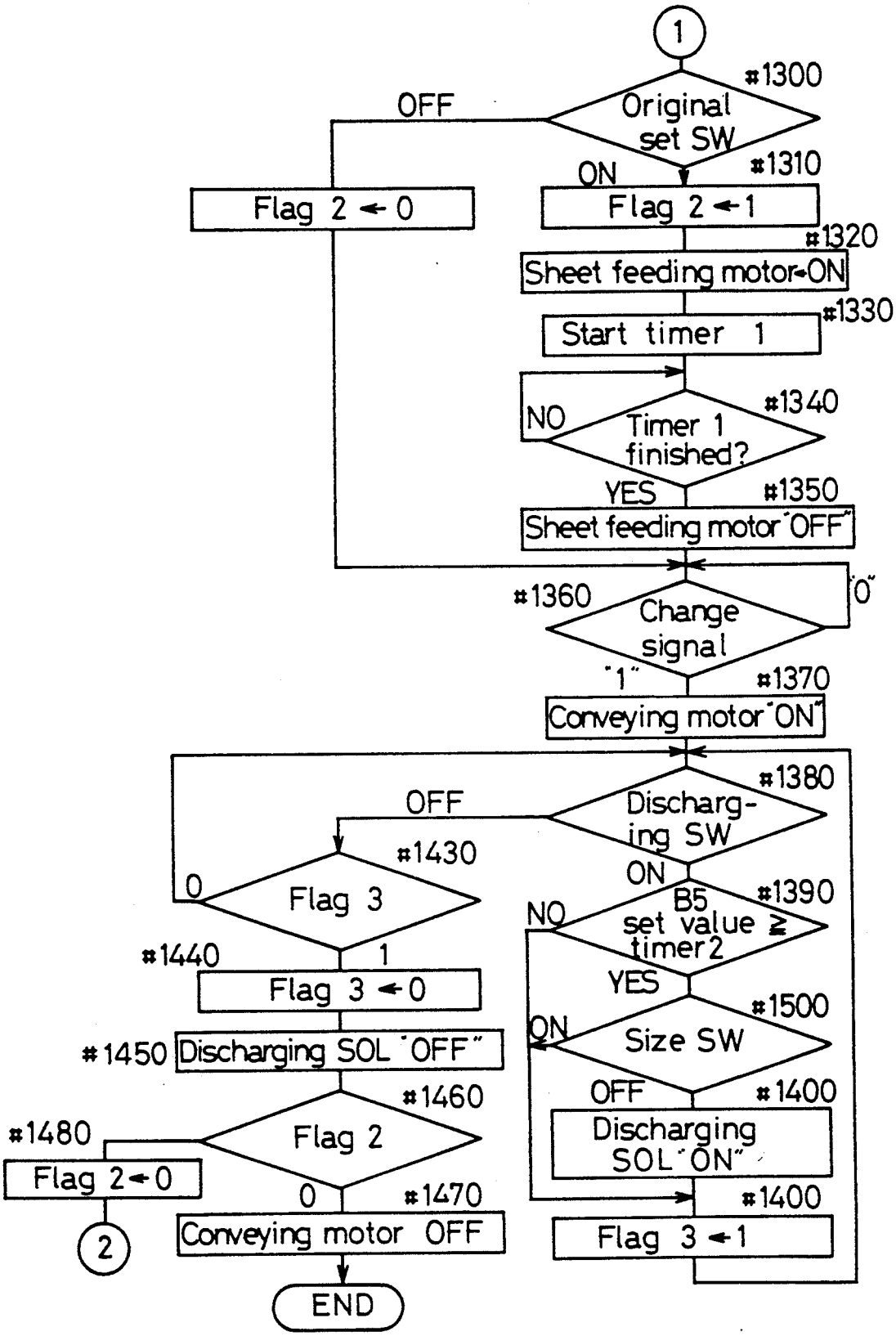
FIG. 10 is a flow chart showing the latter half of an operation of an ADF employing a second embodiment of the present invention.

A specific operation of a second embodiment of the present invention where the size switch is provided to cope with a case where the original is reoriented will be shown in FIG. 10. FIG. 10 is a flow chart showing the latter half of the operation of the second embodiment. The first half thereof is common to the flow of FIG. 8. The second embodiment is intended to cope with the A5 to A3 sizes.

Moreover, in the second embodiment, an operation the same as that of the first embodiment of FIGS. 8 and 9 is performed except that step #1500 is added between steps #1390 and #1400 of FIG. 9. At step #1500, when the length of the side, along an original conveying direction, of an original is sensed by a size switch provided within the range a1 or a2 of FIG. 11 even if the length is long enough to activate the solenoid 21 (the size switch is turned on when an original is placed on the size switch), determining that the original is conveyed along a shorter side, the discharging solenoid 21 is disabled.

Figure 12:
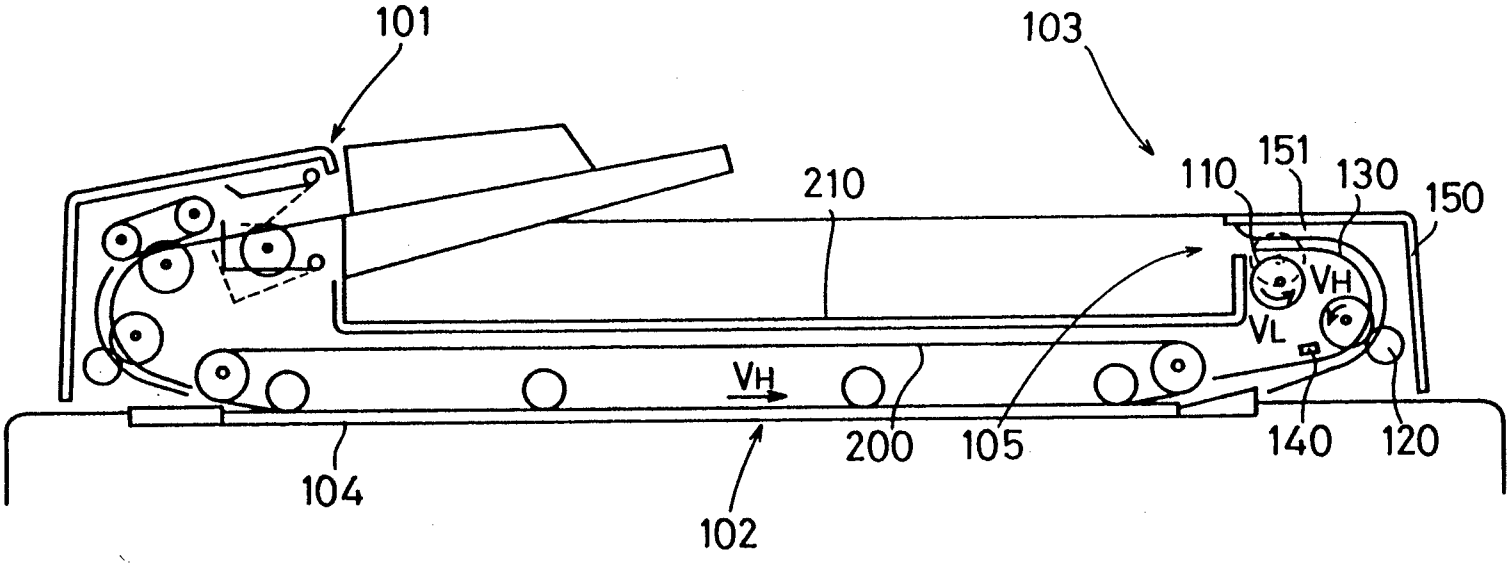
FIG. 12 is a front view cross-sectionally showing a schematic arrangement of a third embodiment of the present invention.
Figure 14A:
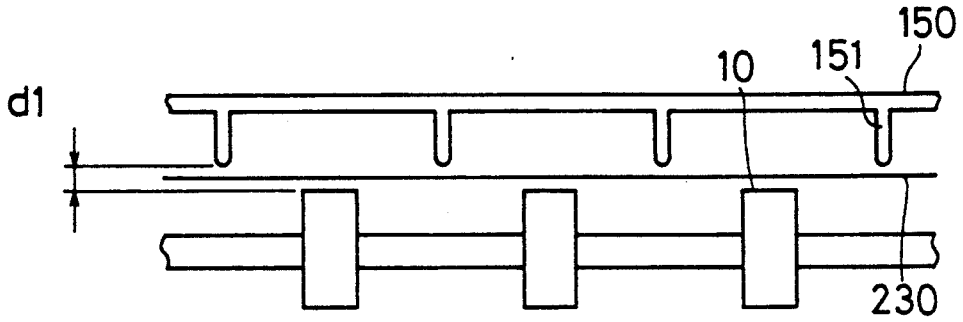
FIGS. 14A and 14B are views schematically showing an operation of a brake mechanism under OFF and ON conditions of a solenoid which operation is viewed from the front in the third embodiment of the present invention.
Figure 14B:
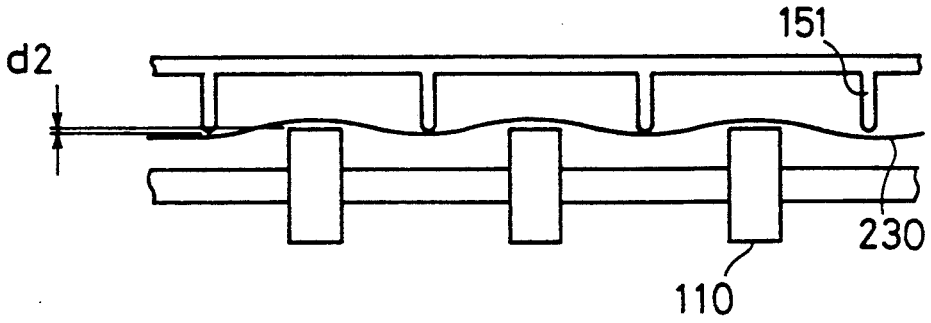

FIG. 12 schematically shows a general arrangement of an ADF which is a third embodiment of the present invention. An operation of each portion is all controlled by a CPU (central processing unit). First, originals are fed one by one from an original feeding portion 101 to an original conveying portion 102, and the originals are stopped at a predetermined position on a contact glass 104 for a copying operation. After the copying operation, the original is conveyed to an original discharging portion 103 by a movement of a conveying belt 200 (with a movement speed VH). At the original discharging portion 103, the original is conveyed through a discharging path 130 by conveying rollers 120 made of rubber (for example, urethane rubber) to a discharging roller 110. Then, the original is nipped between a guide rib 151 provided to a discharging cover 150 and the discharging roller 110 arranged opposite thereto, and is discharged onto a discharging tray 210. FIGS. 14A and 14B show conditions of the discharging roller 110 and the guide rib 151 viewed from a discharging outlet 105 side. As shown in the figures, the discharging roller 110 has a plurality of spaces 110*a* therein which are arranged opposite guide ribs 151, so that the guide ribs 151 can overlap the discharging roller 110.

After an image reading process is finished, the original is conveyed toward the original discharging portion 103 at a peripheral speed VH by the conveying belt 200 as shown in FIG. 12. Then, it is discharged also at the speed VH by the conveying rollers 120. At this time, a solenoid 175 is activated (FIG. 13B) when a sensor 140 (for example, micro switch) provided in the downstream side of the conveying rollers 120 senses the rear tip of the original. When the solenoid 175 is activated, the discharging roller 110 which rotates at a peripheral speed VL that is lower than the speed VH moves so as to protrude into the discharging path 130 (shown by a dotted line in FIG. 12). When the rear tip of the original is released from the nipping by the conveying rollers 120 just after the solenoid 175 is activated as shown in FIG. 13B, the original 230 is nipped in a wavy condition between the discharging roller 110 and the guide rib 151 as shown in FIG. 14B, and is discharged onto the discharging tray 110 at a speed VL.

Figure 13A:
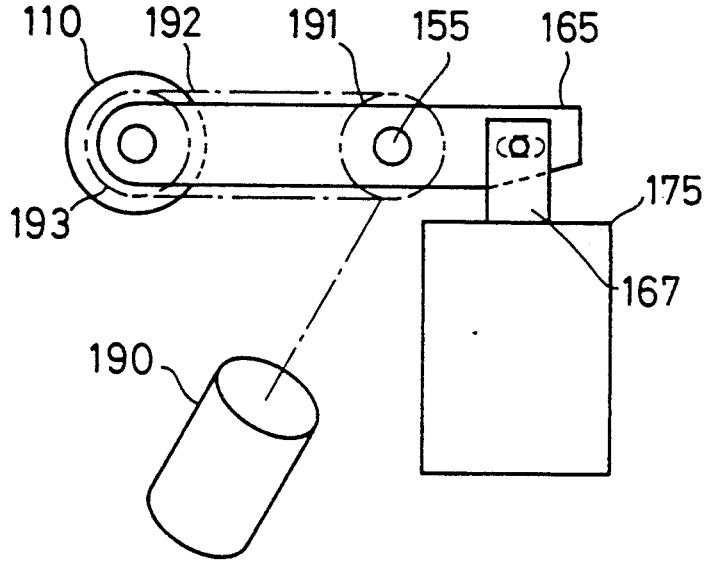
FIGS. 13A and 13B are views schematically showing an operation of a brake mechanism under ON and OFF conditions of a solenoid which operation is viewed from the front in the third embodiment of the present invention.
Figure 13B:
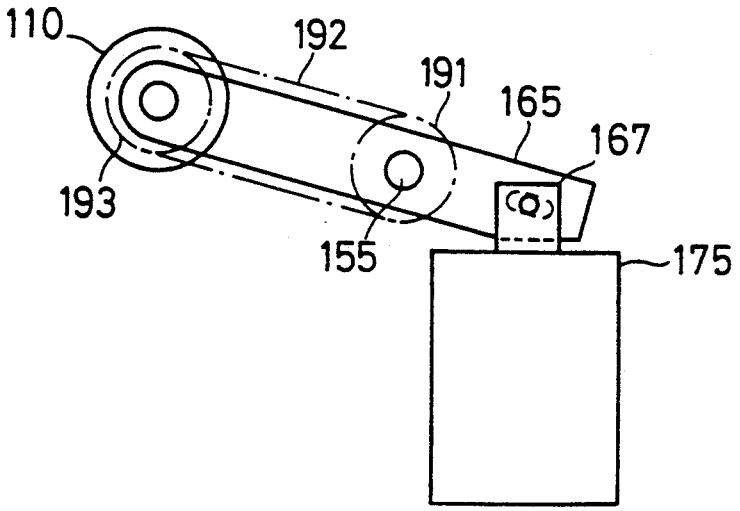

FIGS. 13A and 13B show an operation of a braking mechanism of the third embodiment. As shown in the figures, a shaft-shaped fulcrum 155 is supported by frames arranged at the front and rear of the ADF, and an arm 165 is attached so as to be swingable with respect to the fulcrum 155. On one end of the arm 165, the discharging roller 110 made of sponge (it is desirable to use a material made of sponge) is rotatably attached. On the other end of the arm 165, a plunger 167 is attached by engaging a protrusion with a hole. The plunger 167 is movable upward and downward by ON/OFF of the solenoid 175 provided as shown in FIGS. 13A and 13B. Moreover, a rotation of a driving motor 190 is transmitted to the discharging roller 110 through an idle pulley 191, a toothed belt 192 and a discharging puller 193.

Under OFF condition of the solenoid shown in FIG. 13A, the arm 165 rotates counterclockwise due to the dead load thereof (including the dead load of the discharging roller 110), so that the discharging roller is brought down. When the solenoid 175 is activated, the plunger 167 is drawn into the solenoid 175. Since the protrusion provided to the plunger 167 is engaged with the long hole provided to the end of the arm 165, the discharging roller 110 is brought up by the plunger 167's being drawn into the solenoid 175.

The discharging roller 110 and the conveying rollers 120, which are driven by the driving motor 190, rotate at the peripheral speed VL and at the speed VH, respectively (VL<VH). The peripheral speeds VL and VH can be adjusted by properly setting a reduction ratio from the driving motor 190. There is no problem if the driving motor 190 is also used for another unit such as the original conveying portion 102.

As shown in FIG. 14A, under OFF condition of the solenoid 175, a space d1 is formed between the discharging roller 110 and the guide rib 151 integrally formed on the discharging cover 150. The space d1 corresponds to the discharging path 130 (see FIG. 12). While being conveyed through the space d1, the original 230 is discharged at a high speed (that is, at the speed VH) by the conveying rollers 120.

Moreover, as shown in FIG. 14B, under ON condition of the solenoid 175, an overlap d2 is formed between the discharging roller 110 and the guide rib 151. The original 230 is brought into a wavy condition by the overlap d2. Since the original 230 is separated from the conveying rollers 120, the original 230 is discharged at a low speed (that is, at the speed VL).

Since the nipping of the original 230 by the sponge-made discharging roller 110 and the guide rib 151 provides weak conveying force compared to that provided by the nipping by the rubber-made conveying rollers 120, the original 230 slips between the discharging roller 110 and the guide rib 151 due to force provided by the conveying rollers 120 from the time when the rear tip of the original 230 is sensed by the sensor 140 to the time when the originaL 230 is separated from the conveying rollers 120. Therefore, the discharging speed at that time is the speed VH.

The reason why the solenoid 175 is activated just before the rear tip of the original 230 is separated from the conveying rollers 120 is as follows: if the solenoid 175 is activated earlier, since the original 230 receives different driving forces from the discharging roller 110 and rollers 120 for a longer period of time, paper jam is apt to occur particularly when a thin sheet and a large-size sheet are discharged; moreover, if the solenoid is activated after the rear tip of the original 230 is separated from the conveying rollers 120, since the original 230 moves without receiving any force from the discharging roller 110 and conveying rollers 120 for a period of time, the stocking capability deteriorates due to an oblique conveying of the original 230 and a shift of the front and rear positions of the original.

Subsequently, a fourth embodiment of the present invention will be described.

The fourth embodiment has an arrangement the same as that of the third embodiment of FIGS. 12 to 14A and 14B except that a guide 160 corresponding to the guide rib 151 is moved instead of moving the discharging roller 110. Portions the same as those of the third embodiment of FIGS. 12 to 14A and 14B are provided with the same reference designations, and a detailed description thereof will be omitted.

Figure 15:
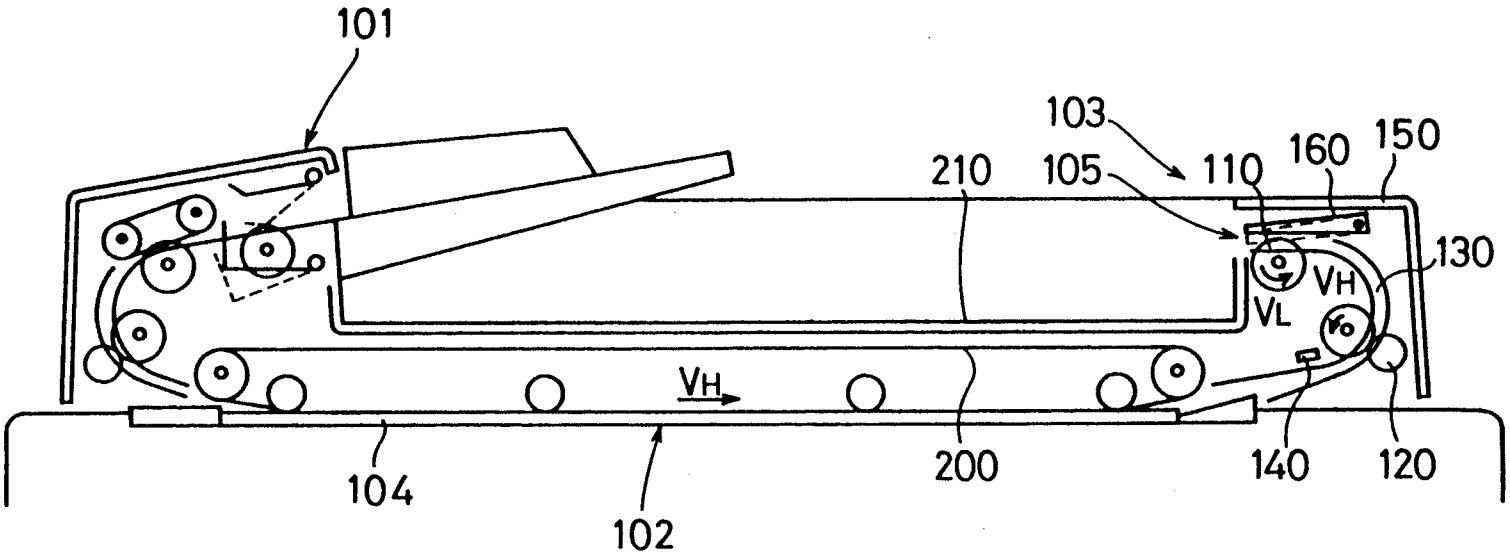
FIG. 15 is a front view cross-sectionally showing a schematic arrangement of a fourth embodiment of the present invention.

FIG. 15 schematically shows a general arrangement of an ADF which is the above-mentioned fourth embodiment of the present invention. As shown in the figure, the discharging roller 110 never moves except that it rotates at the peripheral speed VL. Instead, the guide 160 arranged opposite to the discharging roller 110 swings.

Figure 16:
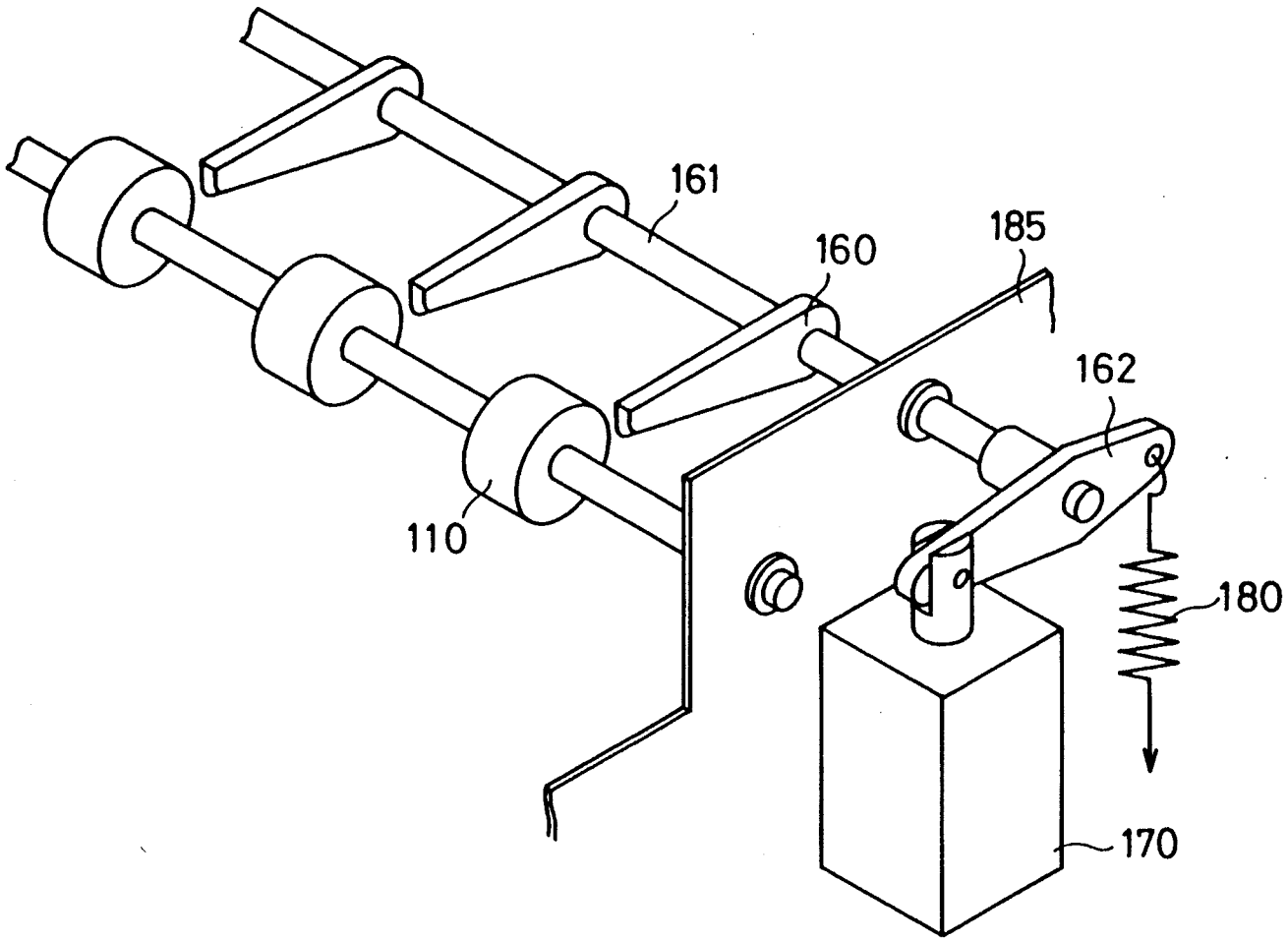
FIG. 16 is a perspective view of a brake mechanism of the fourth embodiment of the present invention.

FIG. 16 is a perspective view showing a braking mechanism of the fourth embodiment. The guide 160 and a lever 162 are integrally formed on a fulcrum 161 rotatably supported by a frame 185. On both ends of the lever 162, a solenoid 170 and a coil spring 180 are attached, respectively. To either one of ends of the lever 162, the tension of the solenoid 170 or the tension of the coil spring 180 is applied downward by ON/OFF of the solenoid 170. The lever 162 rotates according to a balance between the tension of the solenoid 170 and the tension of the coil spring 180, so that the tip of the guide 160 arranged opposite to the discharging roller 110 moves upward and downward. As shown in the figure, there are a plurality of spaces **110*a* in the discharging roller 110 which correspond to the guides on 60, such that the guides can overlap the discharge roller 110**.

Figure 17A:
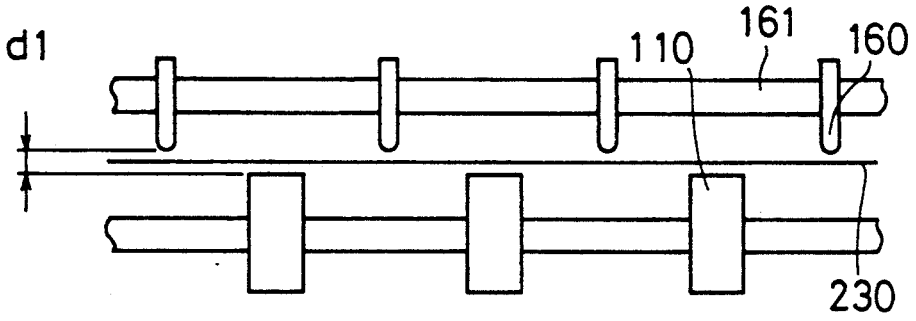
FIGS. 17A and 17B are views schematically showing an operation of the brake mechanism under ON and OFF conditions of a solenoid which operation is viewed from the front in the fourth embodiment of the present invention.
Figure 17B:
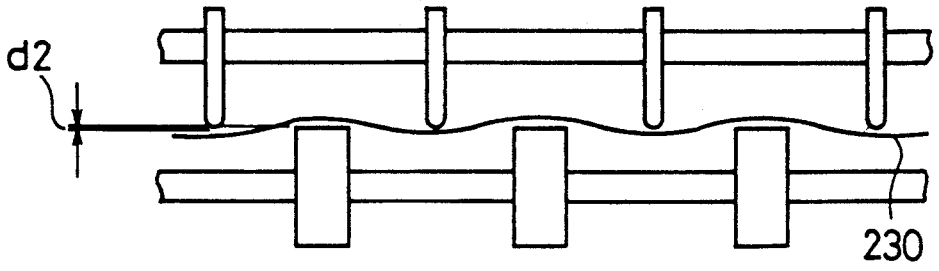

As described with respect to FIGS. 14A and 14B, in the fourth embodiment, a space d1 is also formed between the discharging roller 110 and the guide 160 under OFF condition of the solenoid 170, and an overlap d2 is also formed between the discharging roller 110 and the guide 160 under ON condition of the solenoid 170 as shown in FIG. 17. Force acting on the original 230 under each condition is similar to that of the third embodiment of FIGS. 12 to 14A and 14B.

In the above-described embodiments, since no complicated driving mechanism is required, the arrangements are simple, thereby reducing the required space and cost. Moreover, even if the motor is used also for another unit such as an original conveying portion, the conveying speeds of portions other than the original conveying portion are not reduced. As described above, the present invention provides an excellent stocking capability as well as overcomes disadvantages of prior arts. In the fourth embodiment where the guide 160 is moved, the stocking capability can further be improved by changing the discharging direction to a downward direction by use of the guide 160 when the rear tip of an original is discharged.

Obviously, many modifications and variations of the present invention are possible in light of the above teachings. It is therefore to be understood that within the scope of the appended claims, the invention may be practiced other than as specifically described.

What is claimed is:

1. An original discharging apparatus comprising:
conveying means for conveying an original with respect to which a processing has been finished;
a discharging roller which rotates at a speed lower than an original conveying speed of said conveying means, said discharging roller having at least one space therein;
a guide member provided opposite said discharging roller, said guide member having at least one guide rib;
moving means for moving said discharging roller so that the condition of said discharging roller is changed from a retrieving condition where a discharge speed of an original conveyed through a clearance formed between said guide member and said discharging roller is hardly influenced or not influenced at all by a rotation of the discharging roller to a protruding condition where a discharge speed of an original is heavily influenced by the rotation of the discharging roller; and
controlling means for controlling said moving means so as to be activated before said original being conveyed is separated from said conveying means, and
wherein said protruding condition of said discharging roller is a condition wherein said guide rib of said guide member is in an overlapping relationship with respect to said at least one space of said discharging roller such that an original interposed between said discharging roller and said guide member is nipped and urged into a wavy profile along its width.

2. An original discharging apparatus according to claim 1, wherein said discharging roller is made of a sponge-form material.

3. An original discharging apparatus according to claim 1, where said guide member is fixed to a discharging cover provided over said discharging roller.

4. An original discharging apparatus according to claim 1, wherein sensing means for sensing a position of a conveyed original is provided in an upstream side of said conveying means and wherein said controlling means controls said moving means based on a position of the original which position is sensed by the sensing means.

5. An original discharging apparatus according to claim 4, wherein said sensing means is means for sensing a rear tip of an original.

6. An original discharging apparatus according to claim 1, wherein said retrieving condition is a condition where a clearance is formed between an exterior surface of said discharging roller and a free end of said guide rib such that said guide member and said discharging roller are in a non-overlapping relationship.

7. An original discharging apparatus according to claim 1, wherein said controlling means controls said moving means so as to activate said moving means just before the original is separated from said conveying means.

8. An original discharging apparatus according to claim 1, wherein said discharging roller includes a plurality of spaces therein.

9. An original discharging apparatus according to claim 1, wherein said guide member includes a plurality of guide ribs spaced from each other along a common support member.

10. An original discharging apparatus comprising:
conveying means for conveying an original with respect to which a processing has been finished;
a discharging roller which rotates at a speed lower than an original conveying speed of said conveying means, said discharging roller having at least one space therein;
a guide member provided opposite said discharging roller, said guide member having at least one guide rib;
moving means for moving said guide member so that the condition of said guide member is changed form a retrieving condition where a discharge speed of an original conveyed through a clearance formed between said guide member and said discharging roller is hardly influenced or not influenced at all by a rotation of the discharging roller to a protruding condition where a discharge speed of an original is heavily influenced by the rotation of the discharging roller; and
controlling means for controlling said moving means so as to be activated before said original being conveyed is separated from said conveying means, and
wherein said protruding condition of said guide member is a condition wherein said guide rib of said guide member is in an overlapping relationship with respect to said at least one space of said discharging roller such that an original interposed between said discharging roller and said guide member is nipped and urged into a wavy profile along its width.

11. An original discharging apparatus according to claim 10, wherein said discharging roller is made of a sponge-form material.

12. An original discharging apparatus according to claim 10, wherein said controlling means controls said moving means based on a position of an original which position is sensed by a sensing means provided for sensing a position of an original.

13. An original discharging apparatus according to claim 12, wherein said sensing means is means for sensing a rear tip of an original.

14. An original discharging apparatus according to claim 10, wherein said retrieving condition is a condition where said clearance formed between an exterior surface of said discharging roller and a free end of said guide rib is such that said guide member and said discharging roller are in a non-overlapping relationship.

15. An original discharging apparatus according to claim 10, wherein said controlling means controls said moving means so as to activate said moving means just before the original is separated from said conveying means.

16. An original discharging apparatus according to claim 10, wherein said discharging roller includes a plurality of spaces therein.

17. An original discharging apparatus according to claim 10, wherein said guide member includes a plurality of guide ribs spaced from each other along a common support member.

18. An original discharging apparatus comprising:
conveying means for conveying an original with respect to which a processing has been finished;
a discharging roller which rotates at a speed lower than an original conveying speed of said conveying means;
a guide member provided so as to be opposite to said discharging roller;

moving means for moving said discharging roller so that the condition of said discharging roller is changed from a retrieving condition where a discharge speed of an original conveyed through a clearance formed between said guide member and said discharging roller is hardly influenced or not influenced at all by a rotation of the discharging roller to a protruding condition where a discharge speed of the original is heavily influenced by the rotation of the discharging roller; and controlling means for controlling said moving means so as to be activated before said original being conveyed is separated form said conveying means, wherein said guide member includes a guide rib fixed to a discharging cover provided over said discharging roller.

* * * * *